US005410839A

United States Patent [19]

Granger

[11] Patent Number: 5,410,839

[45] Date of Patent: May 2, 1995

[54] CHRISTMAS TREE WATERING FUNNEL WITH INDICATING LIGHT AND FLOAT

[76] Inventor: Hugh A. Granger, 1615 S. Pacific, Fullerton, Calif. 92633

[21] Appl. No.: 283,202

[22] Filed: Jul. 18, 1994

[51] Int. Cl.[6] ..... A47G 7/02
[52] U.S. Cl. ..... 47/40.5; 47/79
[58] Field of Search ..... 47/40.5, 79

[56] References Cited

U.S. PATENT DOCUMENTS

| | | | |
|---|---|---|---|
| 1,383,368 | 7/1921 | Ambrose | 47/79 |
| 1,586,676 | 6/1926 | Heath . | |
| 2,809,486 | 10/1957 | Eliot | 47/44 |
| 4,850,137 | 7/1989 | Foster | 47/79 |
| 4,930,252 | 6/1990 | Krause et al. | 47/40.5 |
| 5,054,236 | 10/1991 | Sands | 47/79 |
| 5,076,009 | 12/1991 | Cibor | 47/40.5 |
| 5,299,381 | 4/1994 | Oldenberg | 47/40.5 |
| 5,349,997 | 9/1994 | Rail | 47/40.5 |

*Primary Examiner*—Henry E. Raduazo
*Attorney, Agent, or Firm*—James G. O'Neill

[57] ABSTRACT

An apparatus for maintaining a water supply in a stand supporting a Christmas tree is provided. A rigid funnel body comprises integrally formed top, center, and bottom portions. The funnel has a frusto-conical cross-section that tapers from the top portion to the bottom portion. A flexible coupling is integrally formed between the portions of the funnel to hold them in a desired angular relationship. A light assembly is affixed to the top portion of the funnel. The light assembly includes a light source to indicate that the water supply in the stand has fallen below a desired minimum level. A float assembly is pivotally affixed to the bottom portion of the funnel and is coupled to the light assembly with a connecting member. The float assembly includes a float body that floats on the surface of the water supply to induce movement of the connecting member for energizing the light source.

17 Claims, 1 Drawing Sheet

CHRISTMAS TREE WATERING FUNNEL WITH INDICATING LIGHT AND FLOAT

BACKGROUND OF THE INVENTION

1. Field of the invention

This invention relates generally to devices used for watering cut plants, and more particularly, to an improved apparatus for maintaining a water supply in a stand used to support a Christmas tree.

2. Description of Related Art

The inconveniences of watering Christmas trees supported in stands are well known. The breadth of branches surrounding the stand make it somewhat difficult to reach the stand for filling. Further, since the cut trees rapidly absorb water in the stand, the stand must be frequently re-filled.

A number of different prior art devices for watering Christmas trees have attempted to solve these inconveniences.

U.S. Pat. No. 5,076,009 to Cibor, discloses a Christmas tree watering system. The disclosed watering system includes an elevated reservoir connected to a sealed float valve assembly via tubing. The float valve assembly is strapped to the trunk of the tree to resist tilting. A float element is housed in a float body of the float valve assembly. The float element selectively enables filling of water in the Christmas tree stand from the water supply in the reservoir, to maintain a water level in the tree stand.

U.S. Pat. No. 4,850,137 to Foster, discloses a device for watering and removing water from a cut plant container. A collapsible bulb is retained in a funnel coupled to a tube. Water is added to the plant container through the tubing, via the funnel. The bulb can be compressed to draw water from the cut plant container into the bulb, for disposing of the water.

U.S. Pat. No. 5,054,236 to Sands, discloses a Christmas tree self-watering ornament. The disclosed device includes a reservoir coupled to a flexible conduit. A valve is located at a lowermost end of the conduit. The valve includes a check ball located between spaced webs for permitting selective passage of water through the conduit. The device further includes a fiber optic cable running through the conduit for enhanced use of the device as an ornament.

U.S. Pat. No. 4,930,252, discloses a Christmas tree waterer that includes a reservoir coupled to a water level monitor positioned in a stand. The water level monitor is electrically connected to a solenoid valve. When the water level in the stand falls below a desired level, the monitor triggers a switch to activate the solenoid to enable water to flow from the reservoir to the stand.

Additional plant maintenance devices are disclosed in U.S. Pat. Nos. 2,809,468 to Eliot, 1,586,676 to Heath, and 1,383,368 to Ambrose.

A disadvantage common to the prior art is that there are no means provided to indicate to the user that the water supply in a cut plant container, such as a Christmas tree stand, has fallen below a desired minimum level. A further disadvantage of the prior art is that there is no means to indicate to the user when the water supply level in a reservoir is low or empty.

There is, therefore, a need for an apparatus to indicate to the user that a water supply in a cut plant container, such as a Christmas tree stand or reservoir, has fallen below a desired minimum level.

SUMMARY OF THE INVENTION

It is therefore an object of the present invention to provide an improved apparatus for maintaining a water supply in a cut plant container, such as a stand supporting a Christmas tree.

It is another object of the present invention to provide an apparatus for maintaining a water supply in a stand supporting a Christmas tree that indicates to a user that the water supply has fallen below a desired minimum level.

It is a further object of the present invention to provide an apparatus that provides facile refilling of a stand supporting a Christmas tree.

These and other objects and advantages of the present invention are achieved by providing an improved and simplified apparatus for maintaining a water supply in a stand supporting a Christmas tree. The invented apparatus includes a rigid funnel body comprising at least a top portion and a bottom portion. The top portion is coupled to the bottom portion with an integrally formed flexible coupling. The flexible coupling holds the top and bottom portions in a desired angular relationship. The funnel may further include a center portion extending between the top and bottom portions and integrally formed thereto with the flexible coupling. The funnel has a frusto-conical cross-section that tapers from the top portion to the bottom portion. The funnel provides facile filling and refilling of the stand.

A light assembly is affixed to the top portion of the funnel. The light assembly includes a normally open light circuit. When the circuit is closed, a light source indicates that the water supply in the stand has fallen below a desired minimum level.

A float assembly is pivotally affixed to the bottom portion of the funnel. A connecting member couples the float assembly to the light assembly. The float assembly includes a float body that floats on the surface of the water supply in the stand. As the water supply decreases, the float assembly moves the connecting member downward to close the light circuit for energizing the light source. The connecting member comprises a suitable connecting means that is unobtrusive to viewing of the Christmas tree.

Optionally, a shut-off valve may be pivotally retained in the bottom portion of the funnel and coupled to the float assembly. The shut-off valve regulates the flow of water, held in the funnel, into the water supply, responsive to movement of the float assembly.

BRIEF DESCRIPTION OF THE DRAWINGS

The objects and features of the present invention, which are believed to be novel, are set forth with particularity in the appended claims. The present invention, both as to it's organization and manner of operation, together with further objects and advantages, may best be understood by reference to the following description, taken in connection with the accompanying drawings, in which:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved and simplified apparatus for maintaining a water supply in a cut plant container, such as a Christmas tree stand supporting a Christmas tree.

Figure 1:
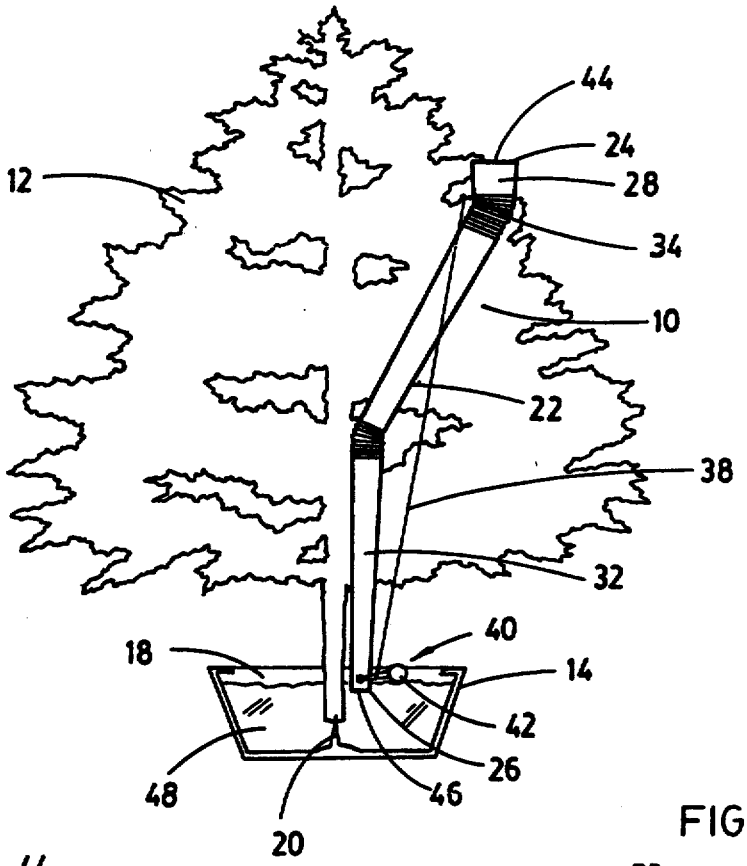
FIG. 1 is a front elevational view showing a preferred embodiment of the present invention secured to a Christmas tree.

Referring now to FIG. 1 of the drawings, there is shown a preferred embodiment of the invented apparatus 10 constructed according to the principals of the present invention. The apparatus 10 is shown secured to a Christmas tree 12 and extending into a stand 14. The apparatus 10 is secured to a trunk 16 of the tree 12 using well known means. The tree's trunk 16 is secured in a cavity 18 of the stand 14, using any known means such as a spike 20.

The apparatus 10 comprises a hollow funnel body 22 with a top end 24 and a bottom end 26. The funnel 22 includes a top portion 28, a center portion 30, and a bottom portion 32. The top 28, center 30, and bottom 32 portions are coupled together using an integrally formed flexible coupling 34.

A light assembly 36 (best seen in FIG. 3) is affixed to the top portion 28 of the funnel 22. A connecting member 38 couples the light assembly 36 to a float assembly 40. The connecting member 38 is dimensioned between the light assembly 36 and float assembly 40, such that it is substantially taut. The float assembly 40 is pivotally affixed to the bottom portion 32 of the funnel body 22. The float assembly 40 includes a hollow float body 42.

In use, water is poured into an opening 44 in the funnel's top end 24. Water runs through the funnel 22, out of an opening 46 in the bottom end 26 of the funnel 22, and into the stand's cavity 18 to form a water supply 48 in the stand 14. The cavity 18 is filled with water until the float body 42 floats on a surface 50 of the water supply 48.

As the tree 12 absorbs the water supply 48, the water supply 48 decreases, pivoting the float body 42 downward relative to the funnel 22. As the float body 42 pivots downward, the float assembly 40 draws the connecting member 38 downward. Once the water supply 48 drops below a desired minimum level, the connecting member 38 causes the light assembly 36 to energize a light source 52 (shown in FIG. 3). The light source 52 indicates to the user that the water supply 48 has fallen below a desired minimum level, and that the water supply 48 should be refilled. The water supply 48 is easily refilled by pouring water into the opening 44 in the funnel's top end 24. When the water supply 48 is full, the connecting member 38 causes the light assembly 36 to turn off the light source 52.

Figure 2:
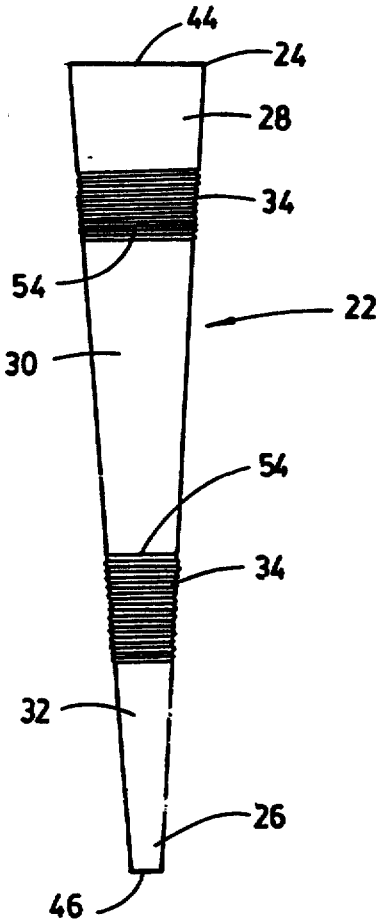
FIG. 2 is a front plan view showing a funnel body of the preferred embodiment.

Referring now to FIG. 2, there is shown the funnel body 22 of the present invention 10. The top 28, center 30, and bottom 32 portions of the funnel body 22, each comprise a substantially rigid, elongated portion having a frusto-conical cross-section, such that the funnel 22 tapers from the top portion 28 to the bottom portion 32. The funnel 22 may be fabricated using any suitable rigid, light material, such as plastic.

The funnel 22 may be fabricated to any suitable length to enable facile filling and refilling of the stand 14. Further, the top 28, center 30, and bottom 32 portions, may be fabricated to any desired individual length, depending upon intended use of the apparatus of the present invention 10. Optionally, the funnel body 22 may be configured with only the top 28 and bottom 32 portions.

The top 28, center 30, and bottom 32 portions of the funnel 22 are held in any desired fixed angular relationship with the flexible coupling 34. The flexible coupling 34 comprises a suitable pliable portion of material that extends between the associated portions 28–30, 30–32, of the funnel 22, and may be integrally formed therewith. Preferably, the flexible coupling 34 is capable of holding the portions 28, 30, 32 of the funnel 22 in a fixed angular relationship. In the preferred embodiment, the flexible coupling 34 comprises a series of expandable and contractable ribs 54. The ribs 54 extend horizontally between the associated portions 28–30, 30–32 of the funnel 22 and are made integral therewith.

Figure 3:
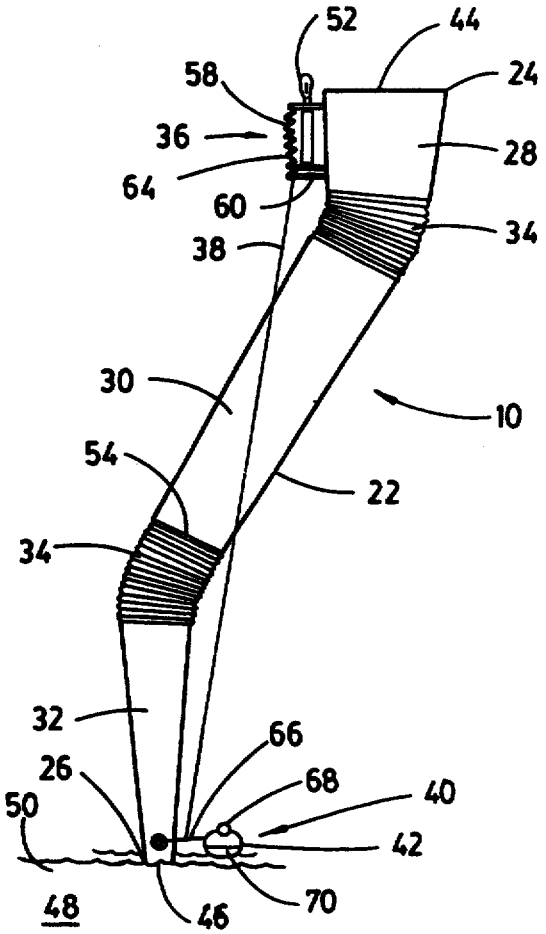
FIG. 3 is a side elevational view of the preferred embodiment of the present invention.

Referring now to FIG. 3 of the drawings, the preferred embodiment of the apparatus 10 of the present invention is shown.

The top 28, center 30, and bottom 32 portions of the funnel 22 are shown held in a fixed angular relationship by the flexible coupling 34.

The light assembly 36 is affixed to the top portion 28 of the funnel 22. The light assembly 36 includes a light circuit comprising the light source 52, such as a low-wattage bulb for example, coupled to a power source 56, such as a suitable battery. A switch 58 that is biased normally open is coupled to the battery 56. The switch 58 may comprise any well known configuration that may be temporarily biased closed, but includes means for returning to the normally open condition. Alternatively, the switch 58 may comprise a well know configuration where the switch 58 may be biased open manually.

A pivot bar 60 has a first end 62 pivotally coupled to the funnel body's top portion 28 and a second end 64. The second end 64 of the pivot bar 60 is coupled to the switch 58 and to the connecting member 38. The pivot bar 60 pivots responsive to movement of the connecting member 38. As the connecting member 38 is drawn downward by the float assembly 40, the pivot bar 60 pivots downward, biasing the switch 58 closed, to cause the battery 56 to energize the light source 52. After with stand 14 is refilled, the pivot bar 60 pivots upward, and the switch 58 is biased open. Alternatively, the user may manually drawn the connecting member 38, or pivot the pivot bar 60, downward to bias the switch 58 open.

The connecting member 38 may comprise any suitable strong, light, connecting means. Preferably, the connecting member 38 comprises a connecting means which is unobtrusive to viewing of the Christmas tree 12. In the preferred embodiment 10, the connecting member 38 comprises a portion of transparent monofilament line.

The float assembly 40 is pivotally affixed to the funnel's bottom portion 32, proximal to the bottom end 26. The float assembly 40 comprises a swing arm 66 pivotally coupled to the bottom portion 32 and coupled to the connecting member 38.

The hollow float body 42 is affixed to the swing arm 66. The float body 42 has a floatation means 68 disposed in an opening 69 thereof. The floatation means 68 may comprise any suitable buoyant material, such as cork for example. The floatation means 68 helps prevent the float body 42 from sinking in the water supply 48.

The float body 42 further includes an adjustable weight means 70 disposed therein. The weight means 70 maintains the float body 42 on the water supply's surface 50 to draw the connecting member 38 downward, as the water supply 48 decreases. As the connecting member 38 is drawn downward by the float assembly 40, the pivot bar 60 pivots to close the switch 58, for energizing the light source 52. In the preferred embodiment 10, the weight means 70 comprises water and is poured into the float body 42 through the opening 69.

Optionally, a shut-off valve (not shown) may be retained in the bottom portion 32 of the funnel 22 and pivotally coupled to the swing arm 66. The shut-off valve is controlled by movement of the float body 42 on the water supply's surface 50. The shut-off valve regulates the flow of water, held in the funnel 22, into the water supply 48.

Thus, there has been described an improved and simplified apparatus for maintaining a water supply in a stand supporting a Christmas tree. The rigid funnel provides facile filling and refilling of the stand. The flexible coupling holds the portions of the funnel in a desired angular relationship. The light assembly includes a light source to indicate to a user that the water supply in the stand has fallen below a desired minimum level. The float assembly includes a float body that floats on the surface of the water supply in the stand. When the water supply decreases below a desired minimum level, the float assembly causes the light assembly to energize the light source. The connecting member is unobtrusive to viewing of the Christmas tree.

Those skilled in the art will appreciate that various adaptations and modification of the just-described preferred embodiments can be configured without departing from the scope and spirit of the invention. Therefore, it is to be understood that, within the scope of the appended claims, the invention may be practiced other than as specifically described herein.

What is claimed is:

1. An apparatus for maintaining a water supply in a stand supporting a cut plant comprising:

a rigid conduit comprising a top portion integrally formed to a bottom portion, said top portion having a diameter greater than the diameter of the bottom portion;

a float assembly pivotally affixed to the bottom portion of said conduit, said float assembly including a float body adapted to float on the surface of the water supply in said stand;

a light assembly affixed to the top portion of said conduit and coupled to said float assembly, said light assembly including a light source activated by movement of said float assembly, said float assembly activating said light source when the water supply in said stand drops below a desired minimum level; and a connecting member affixed to said float assembly and said light assembly for coupling said float assembly to said light assembly.

2. The apparatus of claim 1 wherein said float assembly further comprises a swing arm pivotally coupled to the bottom portion of said conduit and coupled to said connecting member, said float body coupled to said swing arm, said float body having a floatation means affixed thereto for preventing said float body from sinking in said water supply, said float body further including an adjustable weight means therein for maintaining said float body on the surface of the water supply and for pivoting said swing arm for causing vertical movement of said connecting member to activate said light source.

3. The apparatus of claim 2 further including a shut-off valve retained in the bottom portion of said conduit, said shut-off valve coupled to said swing arm and controlled by said float assembly, said valve regulating the flow of water through said conduit into the water supply in said stand responsive to changes in the water supply level.

4. The apparatus of claim 1 wherein said light assembly further comprises:

a light circuit comprising said light source coupled to a power source;

a normally open switch coupled to said power source; and a pivot bar having a first end and a second end, the first end of said pivot bar pivotally coupled to the top portion of said conduit, the second end of said pivot bar coupled to said switch and to said connecting member, said pivot bar pivoting responsive to movement of said connecting member for closing and opening said switch.

5. The apparatus of claim 1 wherein the top portion of said conduit comprises a substantially rigid elongated portion having a frusto-conical cross-section and the bottom portion of said conduit comprises a substantially rigid elongated portion having a frusto-conical cross-section such that said conduit tapers from the top portion to the bottom portion, the top portion of said conduit coupled to the bottom portion of said conduit using a flexible coupling integrally formed therewith.

6. The apparatus of claim 5 wherein said flexible coupling is adapted to hold the top portion and the bottom portion of said conduit in a desired fixed angular relationship.

7. The apparatus of claim 5 wherein said conduit further includes an elongated substantially rigid center portion having a frusto-conical cross-section interposed between the top portion and the bottom portions thereof and flexibly coupled thereto using said flexible coupling, the top, center, and bottom portions of said conduit held in a desired fixed angular relationship by said flexible coupling.

8. The apparatus of claim 1 wherein said connecting member comprises a substantially thin portion of transparent line monofilament line.

9. An apparatus for maintaining a water supply in a stand supporting a Christmas tree comprising:

a rigid funnel body comprising at least a top portion and a bottom portion, said funnel having a frusto-conical cross-section such that said funnel tapers from the top portion to the bottom portion, said top and bottom portions integrally formed together using a flexible coupling such that said flexible coupling holds the top and bottom portions of said funnel in a desired angular relationship;

a light assembly affixed to the top portion of said funnel, said light assembly comprising, a normally open light circuit including a light source;

an actuation means coupled to said light circuit for closing said light circuit;

a connecting member coupled to said actuation means; and a float assembly pivotally affixed to the bottom portion of said funnel and coupled to said connecting member, said float assembly including a hollow float body adapted to float on the surface of the water supply in said stand, said float assembly inducing movement of said connecting member to actuate said actuation means for energizing said light source to indicate that the water supply in said stand has fallen below a desired minimum level.

10. The apparatus of claim 9 wherein said float assembly further comprises a swing arm pivotally coupled to the bottom portion of said funnel and coupled to said connecting member, said swing arm coupled to said float body, said float body having a floatation member affixed thereto for preventing said body from sinking, said float body further including an adjustable weight means therein for maintaining said body on the surface of the water supply in said stand and for pivoting said swing arm for causing vertical movement of said connecting member to actuate said actuation means.

11. The apparatus of claim 9 wherein said light assembly further comprises a power source coupled to said light source, a normally open switch coupled to said power source, said actuation means comprising a pivot bar having a first end and a second end, the first end of said pivot bar pivotally coupled to the top portion of said funnel, the second end of said pivot bar coupled to said switch and to said connecting member, said pivot bar pivoting responsive to movement of said connecting member for closing and opening said switch.

12. The apparatus of claim 9 wherein said flexible coupling comprises a series of expandable and contractable ribs extending between said top and bottom portions and made integral therewith, said flexible coupling adapted to hold the top portion and the bottom portion of said funnel in a desired fixed angular relationship.

13. The apparatus of claim 9 wherein said funnel further comprises an elongated substantially rigid center portion having a frusto-conical cross-section extending between the top portion and the bottom portions thereof and integrally formed with said flexible coupling, the top, center, and bottom portions of said funnel held in a desired fixed angular relationship by said flexible coupling.

14. The apparatus of claim 9 wherein said connecting member comprises a substantially thin portion of transparent monofilament line.

15. An apparatus for maintaining a water supply in a stand supporting a Christmas tree comprising:

a rigid elongated funnel body comprising top, center, and bottom portions, said funnel having a frusto-conical cross-section that tapers from the top portion to the bottom portion, said portions integrally formed together with a flexible coupling, said flexible coupling holding the top and bottom portions of said funnel in a desired angular relationship;

monitoring means pivotally affixed to the bottom portion of said funnel, said monitoring means monitoring the water supply level in said stand; and indicating means affixed to the top portion of said funnel and coupled to said monitoring means, said indicating means adapted to emit a signal, responsive to said monitoring means, when the water supply level in said stand falls below a desired minimum level.

16. The apparatus of claim 15 wherein said monitoring means comprises a float assembly comprising a swing arm pivotally coupled to the bottom portion of said funnel and coupled to a connecting member, said connecting member coupled to said indicating means, a hollow body member coupled to said swing arm, said hollow body having a floatation member affixed thereto for preventing said body from sinking, said hollow body further including an adjustable weight means therein for maintaining said body on the surface of the water supply in said stand and for pivoting said swing arm for causing movement of said connecting member to actuate said indicating means.

17. The apparatus of claim 15 wherein said indicating means comprises a light source coupled to a battery, a normally open switch coupled to said battery, and a pivot bar having a first end and a second end, the first end of said pivot bar pivotally coupled to the top portion of said funnel, the second end of said pivot bar coupled to said switch and to said connecting member, said pivot bar pivoting responsive to movement of said connecting member for closing said switch to energize said light source.

* * * * *